United States Patent [19]

Benzschawel et al.

[11] 4,305,542

[45] Dec. 15, 1981

[54] QUICK FORM TRAY

[75] Inventors: Steven J. Benzschawel, Carol Stream; James F. Nauheimer, Chicago, both of Ill.

[73] Assignee: Container Corporation of America, Chicago, Ill.

[21] Appl. No.: 181,861

[22] Filed: Aug. 27, 1980

[51] Int. Cl.[3] ..... B65D 5/36

[52] U.S. Cl. ..... 229/30; 229/37 E

[58] Field of Search ..... 229/30, 31 R, 34 B, 229/37 E, 31 FS

[56] References Cited

U.S. PATENT DOCUMENTS

| | | | |
|---|---|---|---|
| 2,875,937 | 3/1959 | Vines | 229/30 |
| 2,901,155 | 8/1959 | Vines | 229/30 |
| 2,907,510 | 10/1959 | Vines | 229/30 |
| 3,194,472 | 7/1965 | Crane | 229/30 |

FOREIGN PATENT DOCUMENTS

| | | | |
|---|---|---|---|
| 95170 | 8/1960 | Netherlands | 229/30 |
| 882775 | 11/1961 | United Kingdom | 229/30 |

*Primary Examiner*—Herbert F. Ross

*Attorney, Agent, or Firm*—R. W. Carpenter; Davis Chin

[57] ABSTRACT

An open top tray formed from a one-piece blank of paperboard and adapted to be easily and quickly erected manually.

2 Claims, 4 Drawing Figures

QUICK FORM TRAY

SUMMARY OF THE INVENTION

This invention relates to bulk trays which are adapted to be easily and quickly erected manually from collapsible tubes formed from unitary blanks of foldable sheet material such as paperboard.

It is the object of the invention to provide a tray of the type described, which includes means for squaring up the corners of the tray when the tray is erected, and also for reinforcing the ends of the tray for added stacking strength.

A more specific object of the invention is to provide reinforcing side flanges foldably joined to end walls and disposed to lie against inner surfaces of related tray side walls.

These and other objects of the invention will be apparent from an examination of the following descriptions and drawings.

THE DRAWINGS

It will be understood that, for purposes of clarity, certain elements have been intentionally omitted from certain views where they are believed to be illustrated to better advantage in other views.

THE DESCRIPTION

Figure 1:
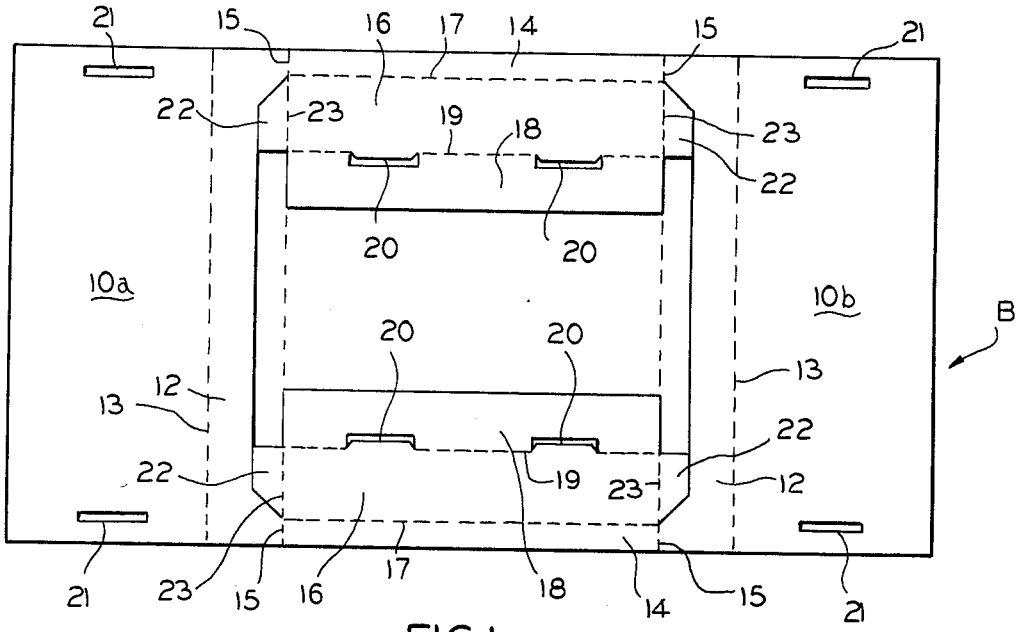
FIG. 1 is a plan view of a blank of foldable sheet material from which the tray illustrated in the other views may be formed.
Figure 2:
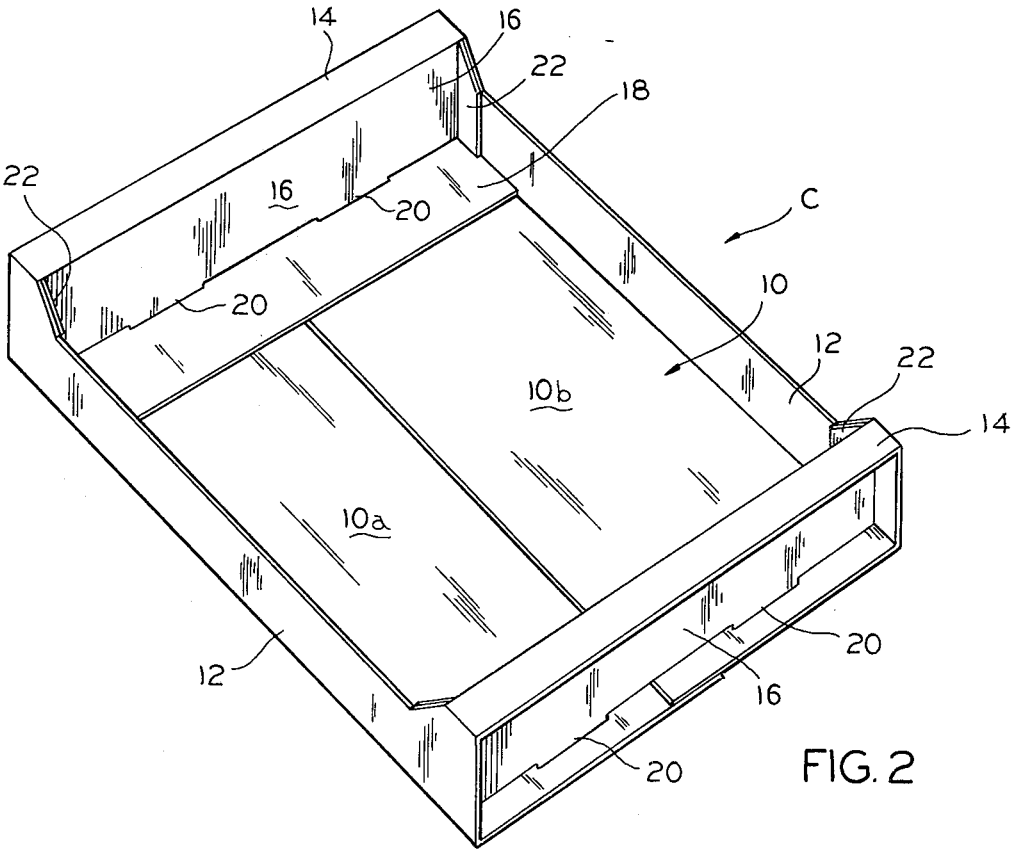
FIG. 2 is a perspective view of an erected tray embodying features of the invention.
Figure 3:
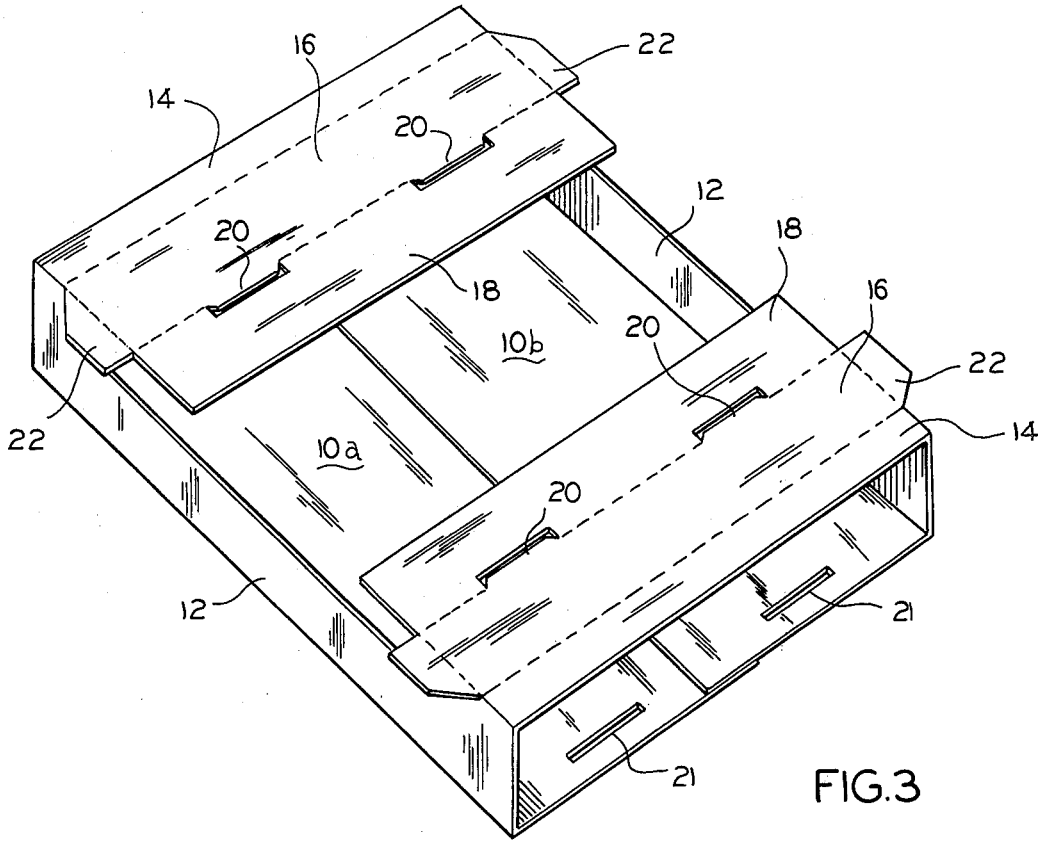
FIGS. 3 and 4 are views similar to FIG. 2 but illustrate separate stages in the forming of the tray.
Figure 4:
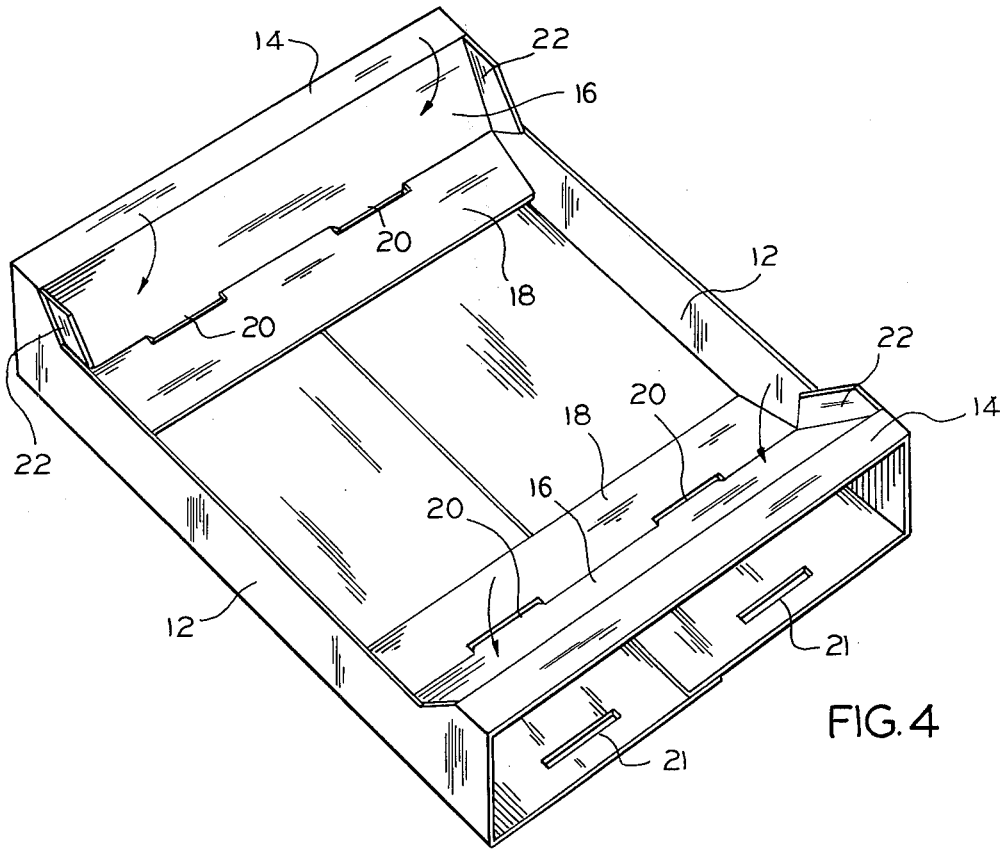

Referring now to the drawings for a better understanding of the invention, it will be seen that the tray indicated generally at T in FIG. 2 may be formed from the unitary blank B of foldable sheet material illustrated in FIG. 1.

The tray is an open top bulk tray which may be easily erected manually from a glued tube which in turn may be formed from a flat blank of paperboard.

Tray T includes a bottom wall panel 10 having a pair of generally co-planer panel sections 10*a* and 10*b* with marginal portions secured to each other in overlapped relation.

Extending upwardly from bottom wall panel 10 are a pair of side wall panels 12 which are foldably joined at their lower edges along fold lines 13 to opposed side edges of bottom wall panel 10.

At the ends of the tray, the side walls are interconnected by a pair of relatively narrow top wall panels 14 which are each foldably joined at their opposed side edges along fold lines 15 to adjacent upper edges of respective side wall panels 12.

Opposite ends of the tray are closed by a pair of end wall panels 16 which are foldably joined at their upper edges along fold lines 17 to inboard edges of respective top wall panels 15. End wall panels 16 extend downwardly for interlocking engagement with bottom wall panel 10 in a manner hereinafter described.

A pair of bottom flanges, which help square the opposed ends of the tray, are foldably joined at their outboard edges at fold lines 19 to the lower edges of respective end wall panels 16. Bottom flanges 18 are disposed to lie in face-to-face relation with the upper surface to bottom all panel 10 and they extend the full width of the tray between opposed the side wall panels 12 with which they have a friction fit.

Additionally, end wall panels 16 may be provided at their lower edges with downwardly projection "Walker" lock type tabs which are received within related openings 21 in bottom wall panel 10.

In order to provide a means for automatically squaring up the corners of the tray when it is being erected and also to provide additional reinforcing in the corners for added stacking strength, there are provided at each end of the tray a pair of side flanges 22 which are foldably joined along their outboard edges on fold lines 23 to related side edges of respective end wall panels 16.

Hence it will be seen that the invention provides a tray, of relatively simple and economic construction, which may be readily erected manually and which includes means for maintaining the walls of the tray in a square condition and reinforcing the walls for added stacking strength.

We claim:

1. A readily erectable open top tray formed from a unitary blank of foldable paperboard, comprising:

(a) a bottom wall panel;

(b) a pair of opposed side wall panels foldably joined at their lower edges to opposite side edges of said bottom wall panel and upstanding therefrom;

(c) a pair of relatively narrow top wall panels located at opposite ends of said tray and each being foldably joined at its opposite ends to upper edges of said side wall panels;

(d) a pair of opposed end wall panels foldably joined at their upper edges to inboard edges of respective top wall panels and extending downwardly therefrom into interlocking engagement with said bottom wall panel;

(e) each of said end wall panels having a pair of side flanges foldably joined at their outboard edges to opposite side edges of said end wall panel;

(f) said side flanges extending inboardly from and normal to said end wall panel and being disposed in face-to-face relation with adjacent inner surfaces of respective side wall panels.

2. A generally rectangular cut and scored blank of foldable sheet material, such as foldable paperboard, for forming a readily erectable tray, comprising:

(a) a pair of bottom wall panels located at remote ends of said blank;

(b) a pair of side wall panels foldably joined at their outboard edges to adjacent inboard edges of respective bottom wall panels;

(c) a pair of top wall panels located at oppostie sides of said blank and being foldably joined at their end edges to adjacent inboard edges of respective side wall panels;

(d) a pair of end wall panels foldably joined at their outboard edges to adjacent inboard edges of respective top wall panels;

(e) a pair of bottom flanges foldably joined at their outboard edges to adjacent inboard edges of respective end wall panels;

(f) each of said end wall panels having foldably joined to its opposite side edges a pair of trapezoidal shaped side flanges;

(g) said side flanges each having at least two side edges detachably joined to adjacent side edges of related side wall panels.

* * * * *